US008390415B2

(12) United States Patent
Ogawa et al.

(10) Patent No.: US 8,390,415 B2
(45) Date of Patent: Mar. 5, 2013

(54) COIL COMPONENT

(75) Inventors: Hideki Ogawa, Takasaki (JP); Tsuyoshi Matsumoto, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/399,794

(22) Filed: Feb. 17, 2012

(65) Prior Publication Data

US 2012/0274429 A1 Nov. 1, 2012

(30) Foreign Application Priority Data

Apr. 28, 2011 (JP) ..... 2011-100512

(51) Int. Cl.

| | |
|---|---|
| ***H01F 27/02*** | (2006.01) |
| ***H01F 38/12*** | (2006.01) |
| ***H01F 27/29*** | (2006.01) |
| ***H01F 17/04*** | (2006.01) |
| ***H01F 27/24*** | (2006.01) |

(52) U.S. Cl. ..... 336/83; 336/84 M; 336/96; 336/192; 336/221; 336/233

(58) Field of Classification Search ..... 336/83, 336/84 M, 96, 192, 221, 233
See application file for complete search history.

(56) References Cited

U.S. PATENT DOCUMENTS

| | | | | |
|---|---|---|---|---|
| 4,797,648 | A * | 1/1989 | Kaneko et al. | 336/192 |
| 4,926,151 | A * | 5/1990 | Morinaga | 335/296 |
| 5,003,279 | A * | 3/1991 | Morinaga et al. | 336/192 |
| 5,010,313 | A * | 4/1991 | Kaneko et al. | 335/296 |
| 5,522,946 | A | 6/1996 | Tomita et al. | |
| 6,154,112 | A * | 11/2000 | Aoba et al. | 336/192 |
| 7,898,375 | B2 * | 3/2011 | Kitajima et al. | 336/83 |
| 2003/0214379 | A1 | 11/2003 | Satoh et al. | |
| 2005/0219027 | A1 | 10/2005 | Satoh et al. | |
| 2006/0071749 | A1 * | 4/2006 | Aoki et al. | 336/83 |
| 2007/0290161 | A1 | 12/2007 | Tokuoka et al. | |
| 2008/0036566 | A1 * | 2/2008 | Klesyk et al. | 336/84 M |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2009/0002112 | A1 * | 1/2009 | Atsushi et al. | 336/83 |
| 2009/0161293 | A1 * | 6/2009 | Takeuchi et al. | 361/321.4 |
| 2010/0289609 | A1 | 11/2010 | Liao et al. | |
| 2010/0321144 | A1 * | 12/2010 | Kudo et al. | 336/192 |
| 2011/0024670 | A1 | 2/2011 | Otsuki et al. | |
| 2011/0267167 | A1 | 11/2011 | Ogawa et al. | |

FOREIGN PATENT DOCUMENTS

| | | | |
|---|---|---|---|
| JP | H07-272952 | A | 10/1995 |
| JP | 2000-138120 | A1 | 5/2000 |
| JP | 2003-282346 | A | 10/2003 |
| JP | 2005-150470 | A | 6/2005 |
| JP | 2005-327876 | A1 | 11/2005 |
| JP | 2010-034102 | A1 | 2/2010 |

* cited by examiner

*Primary Examiner* — Mohamad Musleh
*Assistant Examiner* — Ronald Hinson
(74) *Attorney, Agent, or Firm* — Law Office of Katsuhiro Arai

(57) ABSTRACT

A coil component 10 includes: a magnetic core made of a magnetic alloy; a coil having a spiral part placed around a pillar part of the magnetic core; a magnetic sheath formed on the magnetic core in a manner covering the coil except for the bottom face of the magnetic core; and a first external terminal and second external terminal formed on the magnetic core and magnetic sheath; wherein the magnetic sheath has numerous voids inside.

7 Claims, 3 Drawing Sheets

COIL COMPONENT

BACKGROUND

1. Field of the Invention

The present invention relates to a surface-mount coil component having a structure of a coil placed around the pillar part of a magnetic core.

2. Description of the Related Art

In the field of a surface-mount coil component having a structure of a coil placed around the pillar part of a magnetic core, such as an inductor or choke coil, attempts are being made to change the magnetic core material to a magnetic alloy offering higher magnetic permeability than the conventional ferrite (magnetic ceramics) in order to meet the demand for electrical current amplification in recent years.

A magnetic core made of magnetic alloy is produced by shaping a magnetic paste containing magnetic alloy grains using a die and then heating the shaped paste. Even when heat is applied, however, it is difficult to achieve the sintering action expected of a magnetic core made of ferrite, and consequently the bending strength of the obtained magnetic core itself tends to be lower than that of a conventional magnetic core made of ferrite.

Patent Literatures

[Patent Literature 1] Japanese Patent Laid-open No. 2010-034102

SUMMARY

The object of the present invention is to provide a coil component that can ensure bending strength equal to or better than that of a conventional coil component using a magnetic core made of ferrite, by using a magnetic core made of a magnetic alloy.

To achieve the aforementioned object, the present invention (coil component) is characterized by comprising:

a magnetic core integrally having a sheet part and a pillar part formed on the top face of the sheet part, and made of a magnetic alloy;

a pair of first conductive films formed from the side faces to bottom face of the sheet part of the magnetic core;

a coil integrally having a spiral part where a conductive wire is spirally wound, and one end of the conductive wire and other end of the conductive wire drawn from the spiral part, where the spiral part is placed around the pillar part of the magnetic core, and the one end of the conductive wire is joined to the one first conductive film, while the other end of the conductive wire is joined to the other first conductive film;

a magnetic sheath formed in such a way as to cover the top face of the pillar part and side faces of the sheet part of the magnetic core, surfaces of the side parts of the one and other first conductive films, and surfaces of the spiral part, one end of the conductive wire and joined part at the one end of the conductive wire, as well as other end of the conductive wire and joined part at the other end of the conductive wire, of the coil;

a pair of second conductive films formed from the side faces of the magnetic sheath to the bottom face of the sheet part of the magnetic core, via the bottom face of the magnetic sheath, in such a way that the surfaces of the bottom parts of the one and other first conductive films are covered, respectively; and a pair of third conductive films formed in such a way as to cover the surfaces of the one and other second conductive films, respectively;

wherein the one first conductive film, one second conductive film and one third conductive film constitute a first external terminal, while the other first conductive film, other second conductive film and other third conductive film constitute a second external terminal; and wherein the magnetic sheath has numerous voids inside.

According to the present invention, the magnetic sheath covers not only the top face and periphery of the coil, but also the top face of the pillar part and side faces of the sheet part of the magnetic core, and furthermore the magnetic sheath has numerous voids inside, and therefore the bending resistance of the magnetic core, especially bending resistance of the outer periphery of the sheet part, can be improved by each void demonstrating a buffer action against external and internal forces, thereby enhancing the bending strength of the coil component as a whole. Accordingly, cracks in the magnetic core caused by external forces received when the coil component is installed on a circuit board, etc., or by thermal expansion/contraction of the coil component occurring at the time of reflow soldering, or cracks in the magnetic core caused by thermal expansion/contraction of the coil component after it has been mounted, or other problems can be avoided, thereby improving the reliability of the coil component.

The aforementioned object and other objects, constitutions/characteristics and operations/effects of the present invention are revealed by the following explanations and attached drawings.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

10—Coil component
11—Magnetic core
11*a*—Sheet part
11*b*—Pillar part
12, 13—First conductive film
14—Coil
14*a*—Spiral part
14*b*—One end of conductive wire
14*c*—Other end of conductive wire
15—Magnetic sheath
VD—Void
16, 17—Second conductive film

18, 19—Third conductive film
ET1—First external terminal
ET2—Second external terminal
51—Grain
52—Pore
53—Oxide film
61—Grain
62—Resin
63—Void

DETAILED DESCRIPTION

<<Embodiment 1>>

Figure 1:
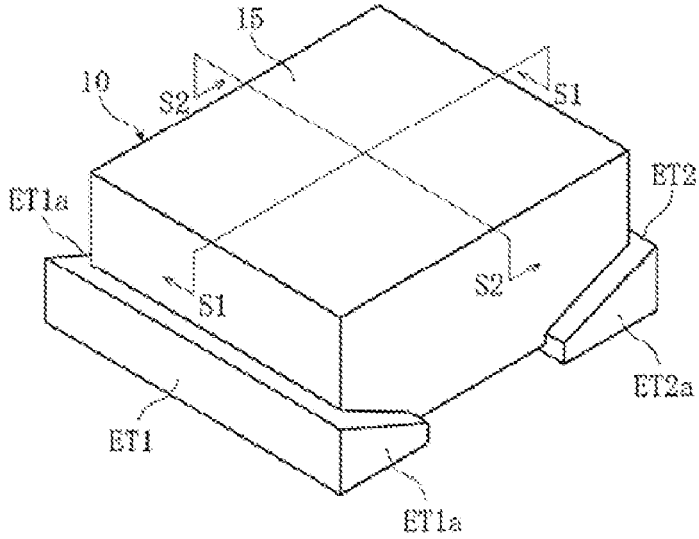
FIG. 1 is a perspective external view of a coil component to which the present invention is applied (Embodiment 1).
Figure 2:
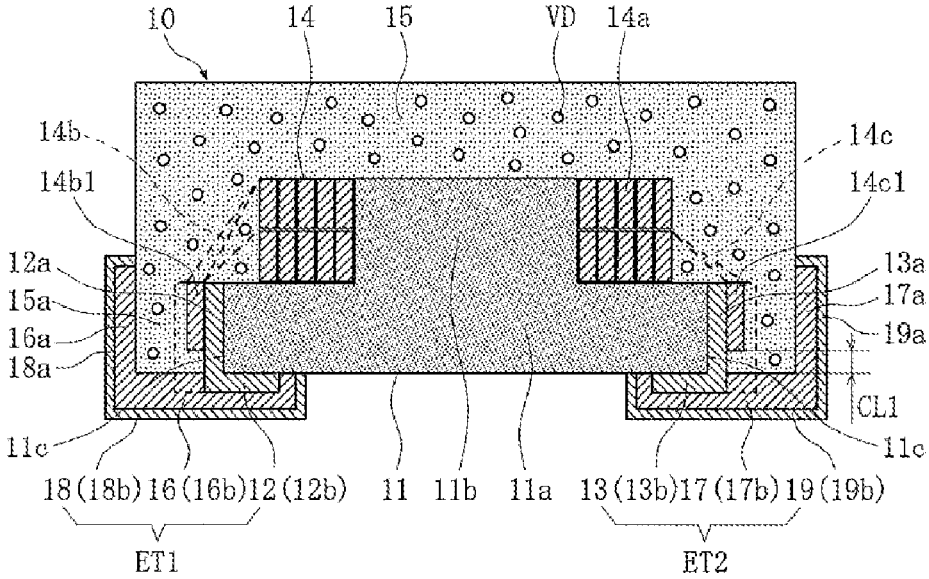
FIG. 2 is an enlarged section view of the coil component shown in FIG. 1, cut along line S1-S1.

FIGS. 1 to 5 show a coil component 10 to which the present invention is applied (Embodiment 1). Here, for the purpose of explanation, top, bottom, left, right, front and rear of FIG. 2 are referred to as top, bottom, front, rear, left and right, respectively, and the same applies to the corresponding directions of FIGS. 1, 3 and 4.

<Structure of Coil Component 10>

The coil component 10 shown in FIGS. 1 to 4 has a magnetic core 11, a pair of first conductive films 12, 13, a coil 14, a magnetic sheath 15, a pair of second conductive films 16, 17 and a pair of third conductive films 18, 19. The size of this coil component 10 is, for example, 2.5 mm in front-rear dimension, 2.0 mm in left-right dimension, and 1.0 mm in top-bottom dimension.

The magnetic core 11 integrally has a sheet part 11*a* having a profile in bottom view of a rough rectangle as well as a specific thickness (such as 0.24 mm when the top-bottom dimension is 1.0 mm), and a pillar part 11*b* provided on the top face of the sheet part 11*a* and having a profile in top view of a rough oval as well as a specific height. Also at approximately the centers on the front face and rear face of the sheet part 11*a*, a concavity 11*c* whose profile in top view constitutes a rough trapezoid is formed, respectively. The height of the pillar part 11*b* with reference to the top face of the sheet part 11*a* is roughly the same as or slightly greater than the height of a spiral part 14*a* of the coil 14.

Figure 5:
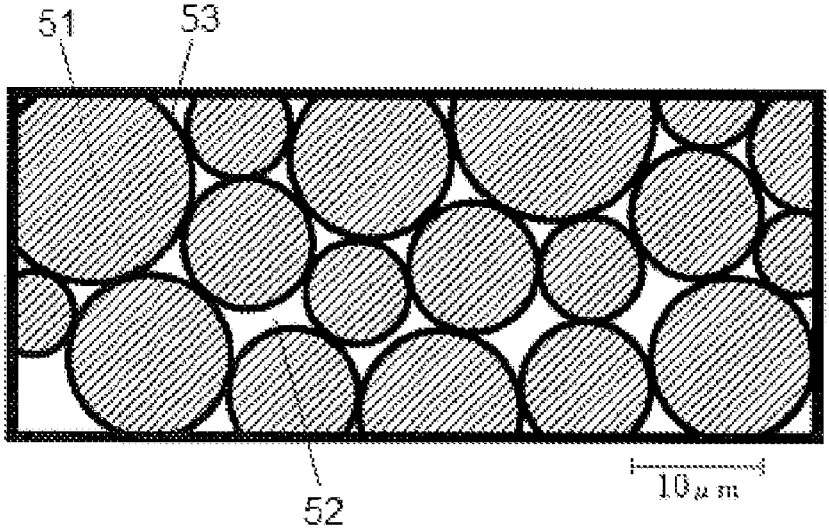
FIG. 5 is a schematic view of a cross section of the magnetic core shown in FIGS. 2 to 4, based on an image obtained by observing the magnetic core with a transmission electron microscope.

The magnetic core 11 is made of a magnetic alloy. To be specific, as shown in FIG. 5, it is constituted by magnetic alloy grains 51 having an oxide film 53 (=insulation film) formed on their surfaces and bonding with one another via the oxide film 53, and this oxide film ensures insulation between adjacent magnetic alloy grains 51. The production method and others are explained as follows. The magnetic core 11 is produced by die-shaping a magnetic paste containing magnetic alloy grains, solvent and binder at a specific mass ratio, and then heat-treating the shaped paste in an oxidizing atmosphere to remove the solvent and binder. An oxide film is formed on the surface of each magnetic alloy grain in the heat treatment process, and also in the heat treatment process, due to removal of the solvent and binder, pores 52 are formed and present between magnetic alloy grains 51 on which the oxide film 53 has been formed. The magnetic alloy grain is preferably a Fe—Cr—Si alloy, Fe—Si—Al alloy, Fe—Ni—Cr alloy, etc., where, based on grain size by volume standard, a desired d50 (median diameter) of the magnetic alloy grain is 3 to 20 μm, while a desired content of magnetic alloy grains in magnetic paste is 85 to 95 percent by weight.

FIG. 5 schematically represents a grain condition of the magnetic core 11, according to an image obtained by observing it with a transmission electron microscope, after producing the magnetic core 11 using Fe—Cr—Si alloy grains whose d50 (median diameter) is 10 μm. Although each magnetic alloy grain is not a perfect sphere in reality, all magnetic alloy grains are depicted as spheres in order to show the grain diameter distribution. Also, while the actual thickness of the oxide film at the surface of each magnetic alloy grain varies in a range of 0.05 to 0.2 μm, all grains are depicted as having a uniform film thickness in order to show that an oxide film is present on each magnetic alloy grain. It is noted that with magnetic alloy grains of Fe—Cr—Si alloy, the oxide film was confirmed to contain the magnetic body $Fe_3O_4$ as well as non-magnetic bodies $Fe_2O_3$ and $Cr_2O_3$.

Note that, while the aforementioned oxide film was obtained by oxidizing elements contained in magnetic alloy grains in the heat treatment process, a substance that would produce an oxide film in the heat treatment process may be added to the magnetic paste beforehand, or a glass component that would produce an insulation film similar to oxide film in the heat treatment process may be added to the magnetic paste beforehand.

The front first conductive film 12 is formed from the front face (including the inner face of the concavity 11*c*) of the sheet part 11*a* of the magnetic core 11 to the bottom front of the sheet part 11*a* and also to the left and right front of the sheet part 11*a*. The rear first conductive film 13 is formed from the rear face (including the inner face of the concavity 11*c*) of the sheet part 11*a* of the magnetic core 11 to the bottom rear of the sheet part 11*a* and also to the left and right rear of the sheet part 11*a*.

The production method and others are explained as follows. The first conductive films 12, 13 are produced by applying a conductive paste containing metal grains, solvent and binder at a specific mass ratio to specific locations on the sheet part 11*a* of the magnetic core 11, and then baking the conductive paste to remove the solvent and binder. The metal grain is preferably a Ag or Pd grain, etc., where, based on grain size by volume standard, a desired d50 (median diameter) of the metal grain is 3 to 20 μm, while a desired content of metal grains in conductive paste is 85 to 95 percent by weight.

In other words, since the first conductive films 12, 13 are baked conductive films offering excellent heat resistance and that do not contain a resin component, etc., any subsequent heat treatment (for example, heat treatment applied when one end 14*b* of the conductive wire or other end 14*c* of the conductive wire is joined, heat treatment applied when the magnetic sheath 15 is produced, or heat treatment applied when the second conductive films 16, 17 are produced) will not cause degradation, displacement or other changes to the first conductive films 12, 13 during the heat treatment and good adhesion between the first conductive films 12, 13 and magnetic core 11 can also be maintained.

The coil 14 integrally has a spiral part 14*a* where a conductive wire is spirally wound, and one end 14*b* of the conductive wire and other end 14*c* of the conductive wire drawn from the spiral part 14*a*. The conductive wire used for this coil 14 is a so-called rectangular wire (conductive wire whose cross-section shape is a rectangle having the long side and short side), and the spiral part 14*a* is wound in the flatwise direction according to the alpha winding method. The conductive wire preferably comprises a Cu, Ag or other metal wire (Cu is desirable from the viewpoint of costs) and an insulation film covering the metal wire, or comprise such metal wire, an insulation film covering the metal wire, and a heat-seal film covering the insulation film (the heat-seal film plays a role to inter-connect the conductive wire constituting the spiral part 14*a*), among others.

Figure 3:
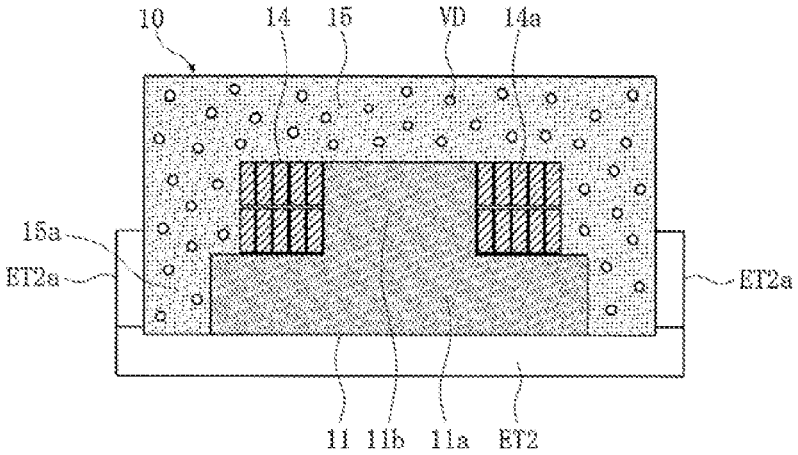
FIG. 3 is an enlarged section view of the coil component shown in FIG. 1, cut along line S2-S2.
Figure 4:
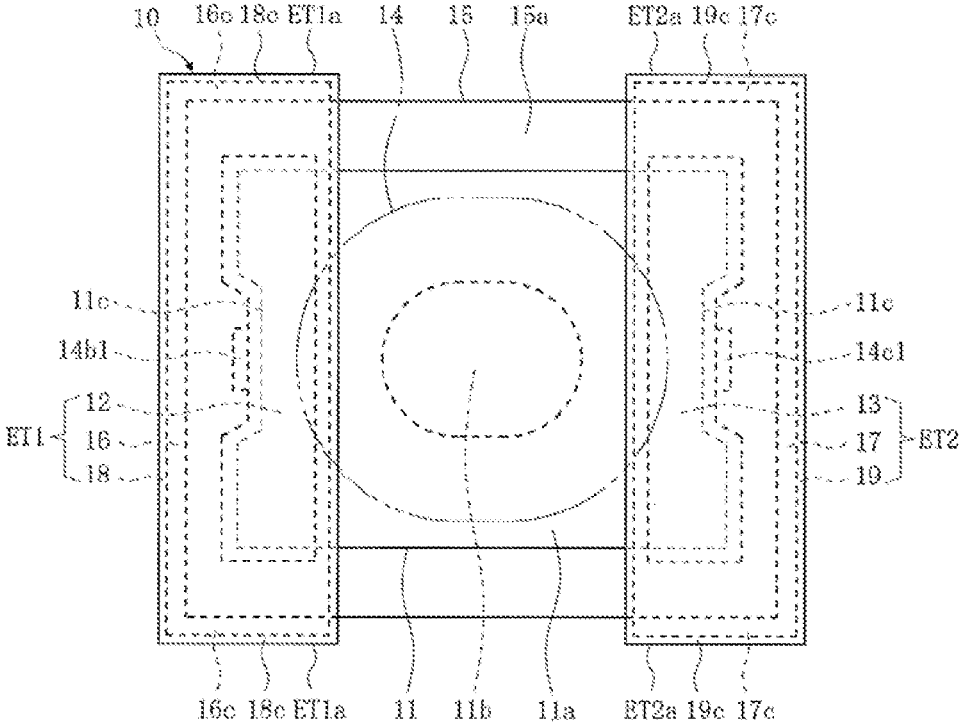
FIG. 4 is an enlarged bottom view of the coil component shown in FIG. 1.

The spiral part 14*a* is placed around the pillar part 11*b* of the magnetic core 11, where the placement method includes directly winding the conductive wire around the pillar part 11*b* to form the spiral part 14*a*, or producing the coil 14 separately and fitting the spiral part 14*a* into the pillar part 11*b*. If the height of the pillar part 11*b* of the magnetic core 11 (height of the pillar part 11*b* with reference to the top face of the sheet part 11*a*) is the same as the height of the spiral part 14*a*, the top face of the spiral part 14*a* after placement becomes roughly flush with the top face of the pillar part 11*b* of the magnetic core 11, as shown in FIGS. 2 and 3. At the tip of the one end 14*b* of the conductive wire, the insulation layer and heat-seal layer covering the tip are removed and then the surface on the long side is electrically connected to roughly the center on the surface of a side part 12*a* of the front first conductive film 12 (position corresponding to roughly the center of the inner face of the concave 11*c*) via diffusion bonding (heat-seal joining). Also at the tip of the other end 14*c* of the conductive wire, the insulation layer and heat-seal layer covering the tip are removed and then the surface on the long side is electrically connected to roughly the center on the surface of a side part 13*a* of the rear first conductive film 13 (position corresponding to roughly the center of the inner face of the concave 11*c*) via diffusion bonding (heat-seal joining).

The top-bottom dimension of a joined part 14*b*1 at the one end 14*b* of the conductive wire and top-bottom dimension of a joined part 14*c*1 at the other end 14*c* of the conductive wire may be the same as the thickness of the sheet part 11*a* of the magnetic core 11, but as shown in FIG. 2, it is preferable to provide a clearance CL1 between the bottom edges of the joined parts 14*b*1, 14*c*1 and bottom face of the sheet part 11*a* because then an area where a part of the magnetic sheath 15 has wrapped around can be formed below the joined parts 14*b*1, 14*c*1. Also, the number of windings of the spiral part 14*a* and cross-section area of the metal wire constituting the conductive wire are specified, as appropriate, according to the inductance, rated current and other characteristic values required of the coil component 10.

As mentioned above, since the first conductive films 12, 13 are baked conductive films offering excellent heat resistance, heat treatment applied when the one end 14*b* of the conductive wire or the other end 14*c* of the conductive wire is joined will not cause degradation, displacement or other changes to the first conductive films 12, 13 during the heat treatment and the first conductive films 12, 13 can be joined favorably with the one end 14*b* of the conductive wire and the other end 14*c* of the conductive wire.

The magnetic sheath 15 has a profile in top view of a rough rectangle and is formed in such a way as to cover the top face of the pillar part 11*b* and front and rear left and right faces (side faces) of the sheet part 11*a* of the magnetic core 11, surfaces of the side parts 12*a*, 13*a* of the first conductive films 12, 13, and surfaces of the spiral part 14*a*, one end 14*b* of the conductive wire and joined part 14*b*1 at the one end 14*b* of the conductive wire, as well as the other end 14*c* of the conductive wire and joined part 14*c*1 at the other end 14*c* of the conductive wire, of the coil 14, and the bottom face of the magnetic sheath is roughly flush with the bottom face of the pillar part 11*b* of the magnetic core 11.

Also, as shown in FIGS. 2 and 3, the magnetic sheath 15 has numerous voids VD inside. In some embodiments, the magnetic sheath is comprised of magnetic alloy grains and an insulation resin, wherein numerous voids are formed. The voids are typically cellular (non-continuous or closed) and formed by, e.g., atmospheric gas already taken into a magnetic paste for forming the magnetic sheath, where the magnetic paste typically contains no separate foaming agent other than magnetic alloy grains and an insulation resin. In some embodiments, the average volume of one of numerous voids VD is preferably $1.4\times10^{-11}$ to $6.5\times10^{-8}$ $cm^3$. In some embodiments, when compared to the volume of the magnetic sheath 15, the total volume ratio of numerous voids VD is preferably 1.5 to 15.0%, which can be determined by, for example, a method comprising: (i) providing a rectangular parallelepiped having dimensions of, e.g., 0.5 mm×0.5 mm×0.2 mm by cutting the magnetic sheath; (ii) confirming that the voids included in the magnetic sheath are closed by a method such as the BET method (if the voids are not closed, the detected surface area will become significantly higher than the planar surface area of the rectangular parallelepiped); (iii) calculating an apparent density of the rectangular parallelepiped based on its volume measured by, e.g., a gaseous displacement method and its weight measured by an electronic balance; (iv) determining compositions of the rectangular parallelepiped by analyzing compositions of the resin components using IR and analyzing compositions of the magnetic power components using X-rays; (v) calculating a theoretical density based on the determined compositions using data from, e.g., data books and catalogues; (vi) calculating the total volume of voids present in the rectangular parallelepiped based on the calculated apparent density and the calculated theoretical density; and (vii) calculating the total volume ratio of the voids based on the total volume of the voids and the total volume of the rectangular parallelepiped.

The magnetic sheath 15 is constituted by magnetic alloy grains and insulation material present between magnetic alloy grains, where this insulation material ensures bonding of adjacent magnetic alloy grains as well as insulation between these adjacent magnetic alloy grains. In some embodiments, gaps between adjacent magnetic alloy grains are substantially or fully filled with the insulation material except for the closed voids (e.g., closed voids having a cross sectional size of about 3 μm to about 50 μm and other voids smaller than the closed voids, if any). The production method and others are explained as follows. The magnetic sheath 15 is produced by die-shaping a magnetic paste containing magnetic alloy grains and thermo-setting insulation material at a specific mass ratio and also containing numerous voids, while inserting a magnetic core 11 (to which a coil 14 has been installed) into the die in such a way that the aforementioned coverage can be ensured, and then hardening the insulation material by heat-treating the shaped paste. The magnetic alloy grain is preferably a Fe—Cr—Si alloy, Fe—Si—Al alloy or Fe—Ni—Cr alloy, etc., where, based on grain size by volume standard, a desired d50 (median diameter) of the magnetic alloy grain is 3 to 20 μm, while a desired content of magnetic alloy grains in magnetic paste is 85 to 95 percent by weight. For the thermo-setting insulation material, epoxy resin, phenol resin, polyester, etc., is a desired choice.

Since the magnetic sheath 15 contains an insulation material constituted by epoxy resin, etc., sufficient adhesion with the magnetic core 11, first conductive films 12, 13 and coil 14 can be ensured by this insulation material.

Figure 6:
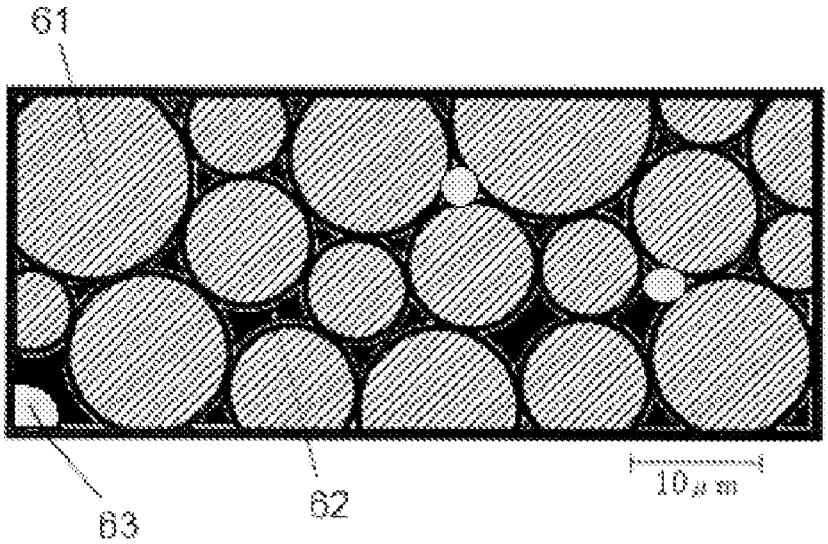
FIG. 6 is a schematic view of a cross section of a magnetic sheath based on an image obtained by observing the magnetic sheath with a transmission electron microscope, according to an embodiment of the present invention.

In some embodiments, the number of voids in the magnetic sheath is defined or expressed as the number of voids having a cross sectional diameter (or maximum dimension) of, e.g., 3 μm to 50 μm observed on a cross section appearing when cutting the magnetic sheath (e.g., observed in an area having dimensions of 0.5 mm×0.2 mm), which can be calculated per square millimeter. In some embodiments, the number of voids having a cross sectional diameter of 3 μm to 50 μm is in a range of 10 to 10,000/$mm^2$ depending on the distribution of void sizes, typically 100 to 1,000/$mm^2$. FIG. 6 is a schematic view of a cross section of a magnetic sheath based on an image obtained by observing the magnetic sheath with a transmission electron microscope, according to an embodiment of the present invention. As illustrated in this figure, in some embodiments, the magnetic sheath is constituted by magnetic alloy grains 61 connected via insulation resin 62, wherein closed voids 63 are present (substantially no other voids such as gaps between grains are observed). The voids are so large as to be observed as closed void portions having a cross sectional size of 3 μm to 50 μm observed on the cross section. In FIG. 6, the voids are indicated as gray spots for illustrative purposes only, but in an image obtained by a transmission electron microscope, the voids are readily recognized as dark spots or dots which are significantly darker than the insulation resin. The cross section of voids is typically generally circular (e.g., a ratio of long-axis dimension to short-axis dimension is less than 2), but can be of any other shape. The number and size of closed voids can be increased by, e.g., using a weight ratio of the insulation resin to the magnetic alloy grains in a range of 5/95 to 15/85 (if the amount of the resin is low, continuous gaps will be formed between grains), using approximately atmospheric pressure for kneading a magnetic paste (if a conventional reduced pressure of −750 mmHg to −730 mmHg is used, voids, if any, in the paste will be shrunk when bringing the kneaded mass back to atmospheric pressure), adjusting the kneading process so as to trap more air in the magnetic paste, etc.

Returning to FIGS. 2 to 4, the front second conductive film 16 is formed from the front bottom of the magnetic sheath 15 to the bottom front of the sheet part 11*a* of the magnetic core 11 via the bottom face of the magnetic sheath 15 and also to the left and right front of the magnetic sheath 15, in a manner covering the surface of a bottom part 12*b* of the front first conductive film 12, and electrically connected to the bottom part 12*b*. The rear second conductive film 17 is formed from the rear bottom of the magnetic sheath 15 to the bottom rear of the sheet part 11*a* of the magnetic core 11 via the bottom face of the magnetic sheath 15 and also to the left and right rear of the magnetic sheath 15, in a manner covering the surface of a bottom part 13*b* of the rear first conductive film 13, and electrically connected to the bottom part 13*b*. Also, the top-edge heights of side parts 16*a*, 17*a* of the second conductive films 16, 17 are set slightly higher than the top-face height of the sheet part 11*a* of the magnetic core 11. Furthermore, the side part 16*a* and a bottom part 16*b* of the front second conductive film 16 are continuously extended with a second side part 16*c* at the left side face and right side face of the magnetic sheath 15, while the side part 17*a* and a bottom part 17*b* of the rear second conductive film 17 are continuously extended with a second side part 17*c* at the left side face and right side face of the magnetic sheath 15.

The second conductive films 16, 17 are constituted by metal grains and insulation material present between these metal grains, where some metal grains contained in the front second conductive film 16 are electrically connected to the surface of the bottom part 12*b* of the first conductive film 12, while some metal grains contained in the rear second conductive film 17 are electrically connected to the surface of the bottom part 13*b* of the rear conductive film 13. The production method and others are explained as follows. The second conductive films 16, 17 are produced by applying a conductive paste containing metal grains and thermo-setting insulation material at a specific mass ratio to specific locations on the magnetic sheath 15 and magnetic core 11 in a manner covering the bottom parts 12*b*, 13*b* of the first conductive films 12, 13, respectively, and then heat-treating the applied paste to harden the insulation material. The metal grain is preferably a Ag or Pd grain, etc., where, based on grain size by volume standard, a desired d50 (median diameter) of the metal grain is 3 to 20 μm, while a desired content of metal grains in conductive paste is 80 to 90 percent by weight. For the thermo-setting insulation material, epoxy resin, phenol resin, polyester, etc., is a desired choice.

Since the second conductive films 16, 17 contain an insulation material constituted by epoxy resin, etc., sufficient adhesion with the magnetic sheath 15, first conductive films 12, 13 and magnetic core 11 can be ensured by this insulation material. Also because the second conductive films 16, 17 have a high content of metal grains, high conductivity can be obtained.

The front third conductive film 18 is formed in a manner covering the surface of the front second conductive film 16, where the film has a side part 18*a* corresponding to the side part 16*a*, a bottom part 18*b* corresponding to the bottom part 16*b*, and a second side part 18*c* corresponding to the second side part 16*c*, of the front second conductive film 16, and is electrically connected to the front second conductive film 16. The rear third conductive film 19 is formed in a manner covering the surface of the rear second conductive film 17, where the film has a side part 19*a* corresponding to the side part 17*a*, a bottom part 19*b* corresponding to the bottom part 17*b*, and a second side part 19*c* corresponding to the second side part 17*c*, of the rear second conductive film 17, and is electrically connected to the rear second conductive film 17.

The production method and others are explained as follows. The third conductive films 18, 19 are produced on the surfaces of the second conductive films 16, 17 by electroplating or other thin-film forming method. A desirable mode of the third conductive films 18, 19 is a two-layer structure comprising a Ni film and a Sn film covering the surface of the Ni film, but the number of layers and materials constituting the layers are not specifically limited as long as connection to the second conductive films 16, 17 can be made in a favorable manner and the coil component 10 can be mounted on a circuit board, etc., or specifically soldered to a connection pad in a favorable manner.

With the aforementioned coil component 10, the front first conductive film 12, front second conductive film 16 and front third conductive film 18 constitute a first external terminal ET1, while the rear first conductive film 13, rear second conductive film 17 and rear third conductive film 19 constitute a second external terminal ET2. In addition, the second side part 16*c* of the front second conductive film 16 and second side part 18*c* of the front third conductive film 18 constitute two wraparound parts ET1*a* on the first external terminal ET1, while the second side part 17*c* of the rear second conductive film 17 and second side part 19*c* of the rear third conductive film 19 constitute two wraparound parts ET2*a* on the second external terminal ET2.

Also with the aforementioned coil component 10, the joined part 14*b*1 at the one end 14*b* of the conductive wire of the coil 14 is sandwiched by the side part 12*a* of the front first conductive film 12 and a part 15*a* of the magnetic sheath 15 covering the side faces of the sheet part 11*a* of the magnetic core 11, and furthermore a part (no reference numeral) of the magnetic sheath 15 covering the surface of the joined part 14*b*1 at the one end 14*b* of the conductive wire of the coil 14 is sandwiched, with the joined part 14*b*1 in between, by the side part 12*a* of the front first conductive film 12 and the side part 16*a* of the front second conductive film 16 as well as the side part 18*a* of the front third conductive film 18. In addition, the joined part 14*c*1 at the other end 14*c* of the conductive wire of the coil 14 is sandwiched by the side part 13*a* of the rear first conductive film 13 and a part 15*a* of the magnetic sheath 15 covering the side faces of the sheet part 11*a* of the magnetic core 11, and furthermore a part (no reference numeral) of the magnetic sheath 15 covering the surface of the joined part 14*c*1 at the other end 14*c* of the conductive wire of the coil 14 is sandwiched, with the joined part 14*c*1 in between, by the side part 13*a* of the rear first conductive film 13 and the side part 17*a* of the rear second conductive film 17 as well as the side part 19*a* of the rear third conductive film 19.

<Desired Manufacturing Method of Coil Component 10>

First, for the magnetic core 11, a magnetic paste containing 85 percent by weight of Fe—Cr—Si alloy grains whose d50 (median diameter) is 10 μm, 13 percent by weight of butyl carbitol (solvent) and 2 percent by weight of polyvinyl butyral (binder) is prepared, and this magnetic paste is shaped using dies and a press machine, after which the shaped paste is heat-treated for 2 hours in an atmosphere of 750° C. to remove the solvent and binder, while an oxide film of magnetic alloy grain is formed on each magnetic alloy grain, to produce the magnetic core 11.

Next, for the first conductive films 12, 13, a conductive paste containing 85 percent by weight of Ag grains whose d50 (median diameter) is 5 μm, 13 percent by weight of butyl carbitol (solvent) and 2 percent by weight of polyvinyl butyral (binder) is prepared, and this conductive paste is applied to the magnetic core 11 using a roller coater, after which the applied paste is baked for 1 hour in an atmosphere of 650° C. to remove the solvent and binder, to produce the first conductive films 12, 13.

Next, the spiral part 14*a* is formed by directly winding around the pillar part 11*b* of the magnetic core 11*a* conductive wire (rectangular wire) for the coil 14 in the flatwise direction according to the alpha winding method, and the tip of the one end 14*b* of the conductive wire (insulation layer and heat-seal layer have already been removed) is joined to the surface of the side part 12*a* of the front first conductive film 12 by means of diffusion bonding (heat-seal joining), while the tip of the other end 14*c* of the conductive wire (insulation layer and heat-seal layer have already been removed) is joined to the surface of the side part 13*a* of the rear first conductive film 13 by means of diffusion bonding (heat-seal joining).

Next, for the magnetic sheath 15, a magnetic paste containing 90 percent by weight of Fe—Cr—Si alloy grains whose d50 (median diameter) is 10 μm and 10 percent by weight of epoxy resin is prepared, and this magnetic paste is shaped, using a die and press machine, for the magnetic core 11 where the coil 14 is placed, after which the shaped paste is heat-treated for 1 hour in an atmosphere of 180° C. to harden the epoxy resin, to produce the magnetic sheath 15.

The magnetic paste for the magnetic sheath 15 is produced by kneading the Fe—Cr—Si alloy grains and epoxy resin at the aforementioned weight ratio using a kneader while heating at 50 to 80° C., where this kneading is carried out in an atmosphere having atmospheric or higher pressure so as to actively cause voids to remain in the magnetic paste, or in other words, to prevent air that has entered the kneaded mixture in the kneading process from exiting the kneaded mixture. The total volume ratio of voids in magnetic paste can be adjusted not only by adjusting the ambient pressure, but also by adjusting the heating temperature, kneading time and other conditions in the kneading process.

Next, for the second conductive films 16, 17, a conductive paste containing 80 percent by weight of Ag grains whose d50 (median diameter) is 5 μm and 20 percent by weight of epoxy resin is prepared, and this conductive paste is applied to the magnetic core 11 and magnetic sheath 15 using a roller coater, after which the applied paste is heat-treated for 1 hour at 150° C. to harden the epoxy resin, to produce the second conductive films 16, 17.

Next, the produced second conductive films 16, 17 are introduced to a Ni electroplating bath to form a Ni film on the surfaces of the second conductive films 16, 17, after which the Ni-covered films are introduced to a Sn electroplating bath to form a Sn film on the surface of each Ni film, to produce the third conductive films 18, 19.

<Effects of Coil Component 10>

(Effect 1) With the aforementioned coil component 10, the magnetic sheath 15 covers not only the top face and periphery of the coil 14, but also the top face of the pillar part 11*b* and side faces of the sheet part 11*a*, of the magnetic core 11, and furthermore the magnetic sheath 15 has numerous voids VD inside, and therefore the bending resistance of the magnetic core 11, especially bending resistance of the outer periphery of the sheet part 11*a*, can be improved by each void VD demonstrating a buffer action against external and internal forces, thereby enhancing the bending strength of the coil component 10 as a whole. Accordingly, cracks in the magnetic core 11 caused by external forces received when the coil component 10 is installed on a circuit board, etc., or by thermal expansion/contraction of the coil component 10 occurring at the time of reflow soldering, or cracks in the magnetic core 11 caused by thermal expansion/contraction of the coil component 10 after it has been mounted, or other problems can be avoided, thereby improving the reliability of the coil component 10.

(Effect 2) With the aforementioned coil component 10, the magnetic sheath 15 surrounding the spiral part 14*a*, one end 14*b* of the conductive wire and the other end 14*c* of the conductive wire, of the coil 14, has numerous voids VD inside, and therefore the forces received by the magnetic sheath 15 when the coil 14 thermally expands can be absorbed by each void VD to prevent cracks from generating in the magnetic sheath 15, while at the same time local peeling of or other damage to the joined part 14*b*1 of the one end 14*b* of the conductive wire and joined part 14*c*1 of the other end 14*c* of the conductive wire can be prevented when the coil 14 thermally contracts.

<<Other Embodiment>>

(1) In Embodiment 1 mentioned above, the coil 14 was presented where a rectangular wire was used as the conductive wire for the coil 14 and its spiral part 14*a* was wound in the flatwise direction according to the alpha winding method, but the spiral part 14*a* may be wound in the edge-wise direction or according to any method other than alpha winding, and any conductive wire other than rectangular wire (such as a round wire) may be used as the conductive wire for the coil 14. In essence, the same effects as mentioned above can be achieved even when the section shape, winding direction or winding method of the conductive wire for the coil 14 is changed.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. In this disclosure, any defined meanings do not necessarily exclude ordinary and customary meanings in some embodiments. Also, in this disclosure, "the invention" or "the present invention" refers to one or more of the embodiments or aspects explicitly, necessarily, or inherently disclosed herein.

The present application claims priority to Japanese Patent Application No. 2011-1005126, filed Apr. 28, 2011, disclosure of which is incorporated herein by reference in its entirety. In some embodiments, as the magnetic core, those disclosed in co-assigned U.S. patent application Ser. No. 13/092,381 (US 2011/0267167 A1), Ser. No. 13/277,018, and Ser. No. 13/313,982 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

a magnetic core integrally having a sheet part and a pillar part formed on top of the sheet part, and made of a magnetic alloy;

a pair of first conductive films separately formed from respective side faces to a bottom face of the sheet part of the magnetic core;

a coil integrally having a spiral part where a conductive wire is spirally wound, and one end of the conductive wire and other end of the conductive wire drawn from the spiral part, where the spiral part is placed around the pillar part of the magnetic core, and the one end of the conductive wire is joined to the one first conductive film, while the other end of the conductive wire is joined to the other first conductive film;

a magnetic sheath formed wherein the magnetic sheath covers a top face of the pillar part and the side faces of the sheet part of the magnetic core, surfaces of side parts of the one and other first conductive films, and surfaces of the spiral part, one end of the conductive wire and joined part at the one end of the conductive wire, as well as other end of the conductive wire and joined part at the other end of the conductive wire, of the coil;

a pair of second conductive films separately formed from respective side faces of the magnetic sheath to the bottom face of the sheet part of the magnetic core, via a bottom face of the magnetic sheath, wherein the surfaces of bottom parts of the one and other first conductive films are covered by the pair of second conductive films, respectively; and a pair of third conductive films separately formed wherein the pair of third conductive films cover the surfaces of the one and other second conductive films, respectively;

wherein the one first conductive film, one second conductive film and one third conductive film constitute a first external terminal, while the other first conductive film, other second conductive film and other third conductive film constitute a second external terminal; and wherein the magnetic sheath has numerous closed voids inside.

2. A coil component according to claim 1, wherein the magnetic core is constituted by magnetic alloy grains having an oxide film formed on their surface and bonding with one another via the oxide film.

3. A coil component according to claim 1, wherein the magnetic sheath is constituted by magnetic alloy grains and an insulation material, wherein gaps between adjacent magnetic alloy grains are substantially filled with the insulation material except for the closed voids.

4. A coil component according to claim 3, wherein a proportion by weight of the insulation material is 5% to 15% relative to the weight of the magnetic sheath.

5. A coil component according to claim 3, wherein the magnetic alloy grains forming the magnetic sheath are Fe—Cr—Si alloy grains, and the insulation material is an epoxy resin.

6. A coil component according to claim 2, wherein the magnetic sheath is constituted by magnetic alloy grains and an insulation material, and the magnetic alloy grains forming the magnetic core and the magnetic alloy grains forming the magnetic sheath are made of the same alloy and have substantially the same median diameter.

7. A coil component according to claim 1, wherein the number of the closed voids is 100 to 1,000/mm$^2$ as measured when counting the number of closed voids having a cross sectional size of 3 μm to 50 μm observed on a cross section appearing when cutting the magnetic sheath.

* * * * *